United States Patent [19]

Nishiguchi

[11] Patent Number: 4,720,039

[45] Date of Patent: Jan. 19, 1988

[54] PAPERBOARD CONTAINER

[75] Inventor: Yoichi Nishiguchi, Tokyo, Japan

[73] Assignee: Jujo Paper Co., Ltd., Tokyo, Japan

[21] Appl. No.: 26,627

[22] Filed: Mar. 17, 1987

[30] Foreign Application Priority Data

Mar. 18, 1986 [JP] Japan ..... 61-59857

[51] Int. Cl.[4] ..... B65D 5/42

[52] U.S. Cl. ..... 229/48 T; 229/3.1; 229/3.5 MF; 229/48 SA; 428/57; 428/458

[58] Field of Search ..... 229/48 T, 48 SA, 4.5, 229/17 R, 17 G, 3.5 MF, 3.1, 198; 428/35, 57, 458

[56] References Cited

U.S. PATENT DOCUMENTS 3,157,336 11/1964 Elam ..... 229/4.5
3,159,515 12/1964 Dunlap, Jr. et al. ..... 229/3.5 MF
3,162,347 12/1964 Taylor ..... 229/3.5 MF
3,274,905 9/1966 Dempsey, Jr. et al. ..... 229/4.5
3,979,048 9/1976 Stark et al. ..... 229/48 T

FOREIGN PATENT DOCUMENTS 58-112944 7/1983 Japan ..... 229/3.5 MF
951341 3/1964 United Kingdom ..... 229/3.1

*Primary Examiner*—Stephen Marcus
*Assistant Examiner*—Gary E. Elkins
*Attorney, Agent, or Firm*—Koda and Androlia

[57] ABSTRACT

A paperboard container made of a paperboard blank with polyethylene coatings on its front and back surfaces, the overlying ends of the paperboard blank being heat sealed through the polyethylene coatings. The container includes a sealing tape which consists of a polyethylene base and a non-heat sealing layer and the polyethylene base is heat sealed to the polyethylene coatings inside the container except for a portion of the heat sealing layer so that the non-heating sealing layer covers the sectional end of the paperboard blank.

11 Claims, 6 Drawing Figures

PAPERBOARD CONTAINER

BACKGROUND OF THE INVENTION

1. Field of the Invention

This invention relates to a paperboard container in which a sealing tape is applied to the overlying heat sealing ends of a paperboard blank in order to reinforce the seal of the overlying ends.

2. Prior Art

Various paperboard containers having polyethylene coatings on both surfaces are used in a wide variety of industrial uses including containers for milk, juice, soy-source, sake, etc. Depending upon the construction, there are two types of containers. One type is constructed by cutting a blank paperboard container out of a flat paperboard blank. The other type is formed by overlaying both sides of a paperboard blank transversely, so that the blank is formed into a tube with bottom panel extensions.

The above described containers, however, have a defect in that when a cross section of the overlying paperboard blank inside of the container comes into contact with the contents of the container (a liquid), the contents penetrate the paperboard wall of the base blank. Thus, the strength of the paperboard blank deteriorates causing the container to become deformed and its strength is greatly decreased.

In order to solve this problem, Japanese Utility Model Laid-Open Application No. 51-71232 disclosed a paperboard container wherein both ends of the container are overlapped to form a gable-top and are brought down to one side. Then, the ends are heat sealed to the outer wall. Japanese Utility Model Laid-Open Application No. 51-49318 disclosed a paperboard container in which the polyethylene coating inside the container is spread at the end of a paperboard blank so that it covers a cross section of the end of the paperboard. Then, it is heat sealed to the outer polyethlene coating.

A method for heat sealing the inside of the overlying end parts of a container has also been proposed wherein a polyethylene strip is used as a sealing tape. The improvement provided in this method, as disclosed in Japanese Patent Laid-Open Application No. 50-90487, lies in the use of a three-layer tape consisting of a material with a higher softening point which uses polyethylene on the front and back surfaces of this material. Among the well known conventional art, the paperboard container described in Japanese Utility Model Laid-Open Application No. 51-71232 has an unsightly appearance due to the extremely thick overlying part and the paperboard container described in Japanese Utility Model Laid-Open Application No. 51-49318 has inferior production efficiency and is not suitable for mass production since the conventional method of cutting a container blank from a flat paperboard blank cannot be applied.

In conventonal containers a sealing tape is used as described in the following paragraph.

Referring to FIG. 5, one side of a sealing tape 20 is heat sealed to one web end 41A. Then the web with the sealing tape is immersed into a disinfectant and dried. Next, both web ends 41A and 41B are overlapped. Lastly, the other side of the sealing tape 20 is heat sealed to the other web 41B. The tape 20 is made of polyethylene and can be damaged easily due the heat of the steam which is generated due to the evaporation of water at the cross of the edge of the web. In order to solve this problem, Japanese Patent Laid-Open Application No. 56-14544 proposed a paperboard container witha tape 30 consisting of three layers, as shown in FIG. 6. However, there are two problems with this prior art. One problem lies in that both of the tape edges consist of three laminated layers and they are in contact with the contents of the container (a liquid). Furthermore, since an adhesive agent (called an "anchor") is used, between the polyethylene layer 32 and the base layer 33, the contents of the container (a liquid) are brought into contact with an adhesive agent.

If the base layer 33 is made of aluminum foil, it is likely that the aluminum will dissolve if it is used to store a strongly acidic juice for a long period of time. Another problem lies in that steam is generated when both end parts 41A and 41B of the paperboard blank are heat sealed. Generally, when a paperboard container is constructed using a tubular form, the end parts 41A and 41B of the paperboard web 41, having polyethylene coatings 42A, 42B, 42C and 42D on both the front and back surfaces, are overlapped, heat sealed and formed into a tubular shape. During the heat sealing process the steam is released through a triangle part 35 from the cross section of the heated end part 41A of the paperboard blank. In this method, the polyethylene coating 32 of the sealing tape 30 and the polyethylene layer 42A of the paper-board blank are wholly heat sealed so that the steam released from the end part 41A cannot be removed. Thus, steam is often entrapped in the form of specks and serves to destabilize the function of the sealing tape 30.

When the specks spread, the seals deteriorate remarkably.

SUMMARY OF THE INVENTION

It is an object of this invention to provide a closed paperboard container which has adequate sealing ability.

It is another object of the present invention to provide a closed paperboard container which does not have any sanitary problems.

According to this invention, a closed paperboard container is made from a paperboard blank with polyethylene coatings on front and back surfaces thereof and heat sealed contact edges. The container includes a sealing tape attached over the entire length inside of the container and the sealing tape consists of a polyethylene base and a non-heat sealing layer which is narrower than the polyethylene base. The sealing tape is heat sealed to the polyethylene coatings on the inside of the container except for a portion of the non-heating sealing layer, which is between the polyethylene base and each of the polyethylene coatings.

DETAILED DESCRIPTION OF THE INVENTION

Referring to FIGS. 1–4, this invention will now be explained below in detail.

Figure 1:
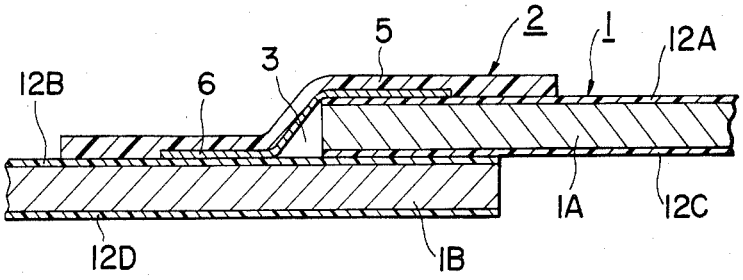
FIG. 1 is a an enlarged sectional view of the overlying ends of the container constructed in accordance with the Example of this invention.
Figure 2:
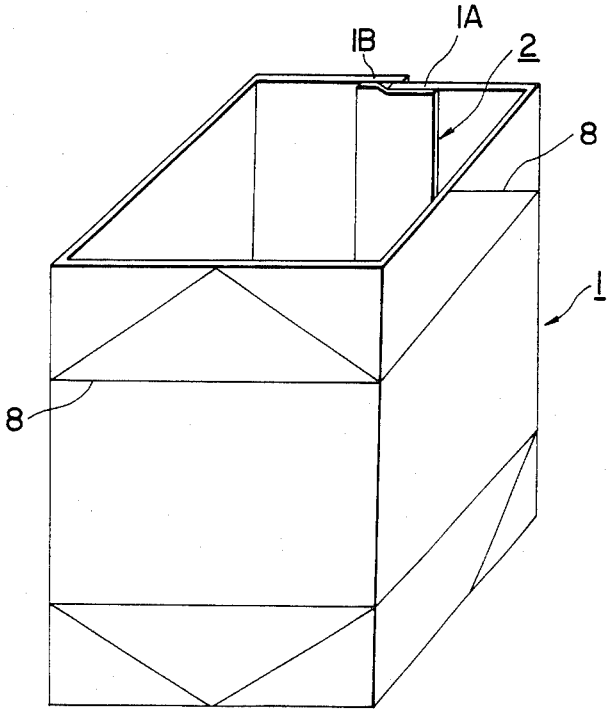
FIG. 2 is a perspective view of the container in accordance with the Example of this invention before filling it with the contents.

In constructing a paperboard container from a paperboard blank, as shown in FIG. 2, a side seal along the entire length of the container is formed as follows. End parts 1A and 1B are overlapped and a polyethylene coating 12C of the end part 1A is heat sealed to the polyethylene coating 12B of the end part 1B. This invention has the following features: As shown in FIG. 1, a sealing tape 2, which consists of a polyethylene base 5 and a non-heat sealing layer 6, is heat sealed to the polyethylene coatings 12A and 12B on the inside of the container of both end parts 1A and 1B, with the exception of the middle part which consists of the non-heat sealing layer 6.

Polyethylene is used as the base material of the sealing tape 2 because heat sealing is applied to the paperboard blank which is coated with the same polyethylene. The non-heat sealing layer 6 prevents band-like melting of the middle portion of the sealing tape 2 during heat sealing.

Hence, the materials of the non-heat sealing layer 6 may consist of, for example, aluminum foil, plastic having a higher melting point than polyethylene, and the like. The preferred plastics are polyethylene terephthalate and polyamide. The plastic is used alone or as a laminate of plastic and/or aluminum foil.

If necessary, an anchor can be used as an adhesive agent between these polyethylene materials or between the laminated materials, and a releasing agent such as silicon resin can be coated on the surface of the non-heat sealing layer 6. Also, the cross section of the end 1A which is exposed inside the container can be covered with the non-heat sealing layer 6. The polyethylene base 5 is heat sealed to the polyethylene coatings 12A and 12B at both sides of the non-heat sealing layer 6. The paperboard container is produced by constructing a paperboard blank 1 and heat sealing the required parts. The paperboard container of this invention has an advantage in that the overlying parts which would make the seals deteriorate are reinforced.

The sealing tape 2 is used for the overlying parts of the ends 1A and 1B of the paperboard blank 1, wherein the overlying end parts 1A and 1B are heat sealed to the polyethylene base 5 exposed at both transverse sides. After heat sealing, the sealing tape 2 can prevent permeation of the contents of the container (a liquid) into the cross section of the paperboard blank 1. In this case, only the polyethylene base 5 is brought into contact with the contents of the container (liquid). The cross section of the laminate consisting of both the polyethylene base 5 and the non-heat sealing layer 6 does not come into contact with the contents of the container (a liquid). Hence, no sanitary problems occur even if an anchor is used when the non-heat sealing layer and the polyethylene base are laminated.

The non-heating sealing layer 6 made of aluminum foil, polyethylene terephthalate, etc. is not heat sealed to the polyethylene coatings 12A and 12B of the paperboard blank 1, leaving a void 3 corresponding to the thickness of the paperboard blank 1.

The void 3 is formed over the entire length (the height in FIG. 2) of the sealing tape 2. However, the void 3 does not cause the sealing ability of the paperboard container to deteriorate since the paperboard container is sealed by both the polyethylene base 5 and the non-heating layer 6. Since the overlying portions of the end parts 1A and 1B of the paperboard blank 1 are processed before the container is filled with its contents (a liquid), either the top or bottom portion, at least, is opened without being tucked in, so that the void 3 formed by heat sealing the sealing tape 2 is open to the atmosphere. Therefore, steam released from the end 1A of the container during heat sealing can be removed through the void 3.

Further, the non-heat sealing layer 6 and each of the polyethlene coatings 12A and 12B are easily separated since there is no heat sealing between them. Hence, the void 3 may become larger. The void 3 has advantageous effects when immersing the paperboard blank into a disinfectant such as hydrogen peroxide, etc. during the sterilization process which is performed before the ends 1A and 1B are heat sealed. For example, even if a disinfectant penetrating into the paperboard layer 1 during the sterilization process blows off at once when the end part 1A is heated, a large amount of steam from the disinfectant can be removed immediately through the void 3 without entrapping the steam between the sealing tape 2 and the paperboard blank 1.

FIG. 2 is a perspective view which schematically shows the paperboard container of the present invention before it is filled with any contents (a liquid).

The sealing tape 2 is heat sealed to the overlying end parts 1A and 1B of the paperboard blank 1.

The paperboard blank 1 has a folding line 8. The paperboard container is heat sealed using sealing tape 2. Then the bottom portion is folded along the bottom folding line 8, the container is filled with the contents and the top portion is folded and heat sealed in the same manner as the bottom portion.

FIG. 1 is an enlarged view of the overlying part. Both surfaces of the paperboard blank 1 have polyethylene coatings 12A, 12B, 12C and 12D wherein a barrier layer, such as aluminum foil, polyethylene terephthalate, etc. can be used as an under coating of the polyethylene coatings 12A, 12b, 12C and 12D. The sealing tape 2 is made of a polyethylene base 5 with a non-heat sealing layer 6, such as a layer of aluminum foil, underneath. The polyethylene base 5 is wider than the non-heat sealing layer 6 so that it extends in a transverse direction to both sides of the non-heat sealing layer 6. Heat sealing occurs between the mutual polyethylene coatings, for example, between the polyethylene coating 12C of the blank end part 1A and the polyethylene coating 12B of the blank end part 1B, between the sealing tape 2 and the polyethylene coating 12A of the blank end part 1A, and between the sealing tape 2 and the polyethylene coating 12B of the blank end part 1B. On the other hand, the aluminum foil 6 and the polyethylene coatings 12A and 12B are not heat sealed, but tightly fit together. Since the thickness of the end 1A creates the void 3 which is open to the atmosphere, steam can escape from the cross section of the end part 1A of the paperboard blank 1. The cross section of the void 3 may expand depending upon the pressure of the steam, so that the steam may be removed completely. Thus, the steam has no bad or ill effects on the bonded area between the polyethylene base 5 of the sealing tape 2 and the polyethylene coatings 12A and 12B of the end part 1A or 1B.

Figure 3:
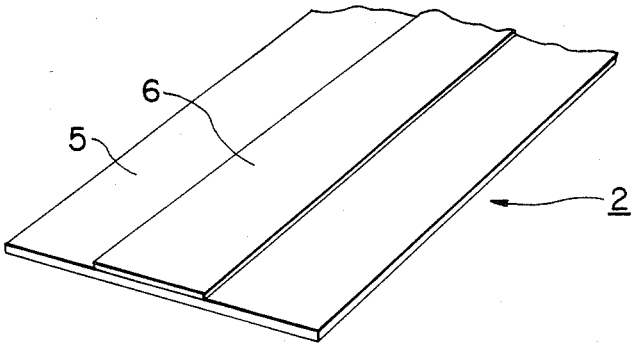
FIGS. 3 and 4 are perspective views of sealing tape according to this invention.
Figure 4:
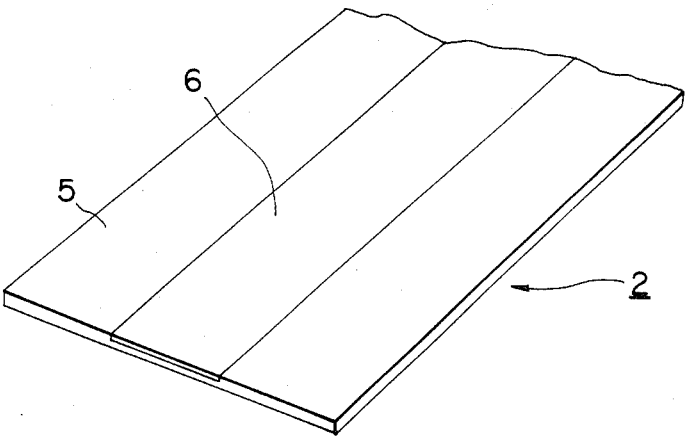
Figure 5:
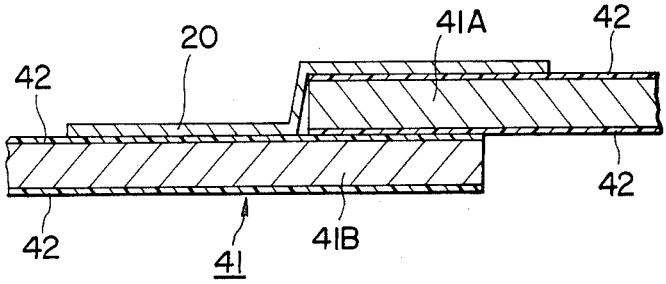
FIG. 5 PRIOR ART
FIGS. 5 and 6 are enlarged sectional views of the overlying ends of a conventional container.
Figure 6:
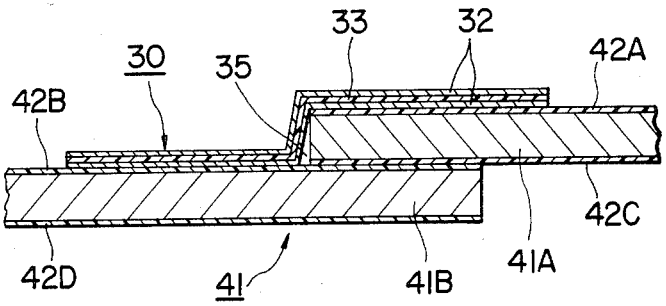
FIG. 6 PRIOR ART

FIGS. 3 and 4 are perspective views which show examples of the sealing tape used in this invention. The sealing tape shown in FIG. 3 is produced by laminating or evaporating the non-heat sealing layer 6 on the polyethylene base 5. The sealing tape 2 in FIG. 4 is produced by overlaying the non-sealing layer 6 on the polyethylene base 5 and pressing the overlying substance during heat sealing. The polyethylene base 5 preferably has a thickness of 60–120 μ, and more preferably, a thickness of 80–100μ.

It is preferred that the non-heat sealing layer 6 be thinner than the polyethylene layer 5. In this case, the aluminum foil is preferably about 5–12μ thick.

The method of using the sealing tape varies depending upon the process for producing the paperboard container.

Referring to FIG. 1, there are two methods:

(1) The end parts 1A and 1B of the paperboard blank 1 are overlapped and then heat sealed using the sealing tape 2;

(2) One side of the sealing tape 2 is heat sealed to the end part 1A, whereas in another process the end parts 1A and 1B are heat sealed, and then the end part 1B and the other side of the sealing tape 2 are heat sealed.

The effects of this invention are as follows:

(a) Exact heat sealing can be obtained between the end parts 1A and 1B of the paperboard blank and between each of the end parts 1A and 1B and the sealing tape 2, since steam released from the end part 1A is removed and not entrapped.

(b) The container is sanitary and safe for food since the cross section of the sealing tape 2 is not brought into contact with the contents (a liquid), and thereby the anchor, etc. does not dissolve into the contents thereof.

(c) The process of producing the container is simple and the quality of the contents thereof are stable when compared with conventional containers having a three layer structure, since the sealing tape 2 of this invention is a two layer structure.

I claim:

1. A paperboard container which has polyethylene coatings on front and back surfaces of a paperboard blank, and in which a contact area of polyethylene coatings of overlying end parts is heat sealed, comprising, over the entire length of a container inside, a sealing tape which consists of a polyethylene base and a non-heat sealing layer, said polyethylene base being wider than said non-heat sealing layer and being heat-sealed to said polyethylene coatings inside of said container except the part consisting of said non-heat sealing layer, said non-heat sealing layer existing between said polyethylene base and said polyethylene coatings.

2. A paperboard container according to claim 1, wherein said non-heat sealing layer is aluminum foil.

3. A paperboard container according to claim 1, wherein said non-heat sealing layer is a layer of plastic having a higher melting point than polyethylene.

4. A paperboard container according to claim 3, wherein said plastic is at least one selected from the group consisting of polyethylene terephthalate and polyamide.

5. A paperboard container according to claim 1, wherein said non-heat sealing layer is a laminate of at least a substance selected from the group consisting of plastic foil and aluminum foil.

6. A paperboard container according to claim 1, wherein an anchor as an adhesive agent is present between the polyethylene materials.

7. A paperboard container according to claim 1, wherein a releasing agent is present on the non-heat sealing layer.

8. A paperboard container according to claim 7, wherein said releasing agent is silicon resin.

9. A paperboard container according to claim 1, wherein said polyethylene base of said sealing tape has a thickness of about 60–120μ.

10. A paperbord container according to claim 9, wherein said polyethylene base of said sealing tape has a thickness of 80–100μ.

11. A paperboard container according to claim 1, wherein an anchor as an adhesive agent is present between the laminating materials.

* * * * *